US006679431B1

(12) United States Patent
Mathew et al.

(10) Patent No.: US 6,679,431 B1
(45) Date of Patent: Jan. 20, 2004

(54) THERMOSTAT HOUSING WITH INTEGRAL VALVE

(75) Inventors: Boney A. Mathew, Clarkston, MI (US); Carl S. Howarth, Bloomfield Hills, MI (US)

(73) Assignee: Mathson Industries, Troy, MI (US)

( * ) Notice: Subject to any disclaimer, the term of this patent is extended or adjusted under 35 U.S.C. 154(b) by 0 days.

(21) Appl. No.: 10/313,375

(22) Filed: Dec. 6, 2002

(51) Int. Cl.[7] ..... F01P 7/16
(52) U.S. Cl. ..... 236/34.5; 137/199
(58) Field of Search ..... 236/34, 34.5; 137/199, 137/202, 519.5

(56) References Cited

U.S. PATENT DOCUMENTS

| | | | | |
|---|---|---|---|---|
| 1,313,522 A | | 8/1919 | Cressy | |
| 2,810,524 A | | 10/1957 | Puster | 236/34 |
| 2,829,835 A | | 4/1958 | Branson | 236/34.5 |
| 2,916,042 A | * | 12/1959 | Brady, Jr. | 137/202 |
| 3,727,635 A | * | 4/1973 | Todd | 137/513.5 |
| 3,861,415 A | * | 1/1975 | Larsen | 137/513.5 |
| 3,973,729 A | | 8/1976 | Sliger | 236/34.5 |
| 4,011,988 A | | 3/1977 | Inagaki | 236/34.5 |
| 4,052,965 A | | 10/1977 | Morris | 123/41.05 |
| 4,091,991 A | | 5/1978 | Sliger | 236/34.5 |
| 4,208,994 A | | 6/1980 | Kitamura | 123/119 |
| 4,273,081 A | | 6/1981 | Cleveland et al. | 123/41.08 |
| 4,296,721 A | | 10/1981 | Steele, Jr. | 123/407 |
| 4,300,718 A | | 11/1981 | Beyer | 236/34.5 |
| 5,289,803 A | | 3/1994 | Matsushiro et al. | 123/41.1 |
| 5,762,093 A | * | 6/1998 | Whitley, II | 137/199 |
| 5,967,101 A | | 10/1999 | Roth et al. | 123/41.29 |
| 5,980,342 A | | 11/1999 | Logan et al. | 440/88 |
| 6,016,828 A | * | 1/2000 | Machledt | 137/202 |
| 6,112,706 A | | 9/2000 | Heer | 123/41.1 |
| 6,138,617 A | | 10/2000 | Kuze | 123/41.1 |
| 6,247,487 B1 | * | 6/2001 | Skill | 137/198 |
| 6,341,618 B1 | * | 1/2002 | Ricci | 137/247.23 |
| 6,471,133 B1 | | 10/2002 | O'Flynn et al. | 236/34.5 |

FOREIGN PATENT DOCUMENTS

| | | |
|---|---|---|
| GB | 1401396 | 7/1975 |

* cited by examiner

*Primary Examiner*—William E. Tapolcai
(74) *Attorney, Agent, or Firm*—Howard & Howard

(57) ABSTRACT

A plastic thermostat housing having a vent passage including a valve portion (46), a cap portion (48), and an outlet portion (54), with the cap portion (48) being larger in cross sectional area than the cap, portion (48). A check valve (52) is inserted into the valve portion (46) and a cap (50) with a vent hole (56) is inserted into the cap portion (48) for retaining the check valve (52) in the vent passage. The assembly is characterized by the plastic material of the housing (12) being deformed into engagement with the cap (50) for retaining the cap (50) in the valve portion (48) of the vent passage. The cap (50) may comprise a plastic material to be fused to the housing (12).

11 Claims, 3 Drawing Sheets

THERMOSTAT HOUSING WITH INTEGRAL VALVE

BACKGROUND OF THE INVENTION

1. Field of the Invention

The subject invention relates to a thermostat housing assembly for mounting on an engine to control coolant flow.

2. Description of the Prior Art

It is well known in automotive engine coolant systems to facilitate the venting of gases from the coolant passageway to the radiator to eliminate air pockets. Such systems are shown in U.S. Pat. No. 1,313,522 to Cressy, U.S. Pat. No. 2,810,524 to Puster, U.S. Pat. No. 2,829,835 to Branson, U.S. Pat. No. 3,973,729 to Sliger, U.S. Pat. No. 4,011,988 to Imagaki, U.S. Pat. No. 4,052,965 to Morris and U.S. Pat. No. 4,091,991 to Sliger and U.K. patent 1,401,396.

These prior art systems employ numerous components and/or relatively complex assembly procedures. It is, therefore, an object of the subject invention to provide a simplified vent valve in a thermostat housing that provides the requisite reliability yet is easily and simply fabricated.

SUMMARY OF THE INVENTION AND ADVANTAGES

The invention provides a thermostat housing and a method of fabricating same of plastic material having a flange for mounting the housing on a support structure and a tubular spout extending from the flange and defining a passageway extending from an opening in the spout to an opening in the flange for fluid to flow therethough. The flange presents a mounting face for engaging the support structure and an outer seal groove therein and an outer seal disposed in the outer seal groove for sealing the flange to the support structure. A vent passage extends between the passageway and the mounting face inside the outer seal. A check valve is inserted into the vent passage and a cap having a vent hole therethrough is inserted into the vent passage for retaining the check valve in the vent passage. The invention is characterized by the plastic material of the housing being deformed into engagement with the cap for retaining the cap in the vent passage.

Accordingly, the subject invention provides a vent valve in a thermostat housing which is simple and reliable, yet fabricated in a very efficient method.

BRIEF DESCRIPTION OF THE DRAWINGS

Other advantages of the present invention will be readily appreciated as the same becomes better understood by reference to the following detailed description when considered in connection with the accompanying drawings wherein:

FIG. 2 is a perspective view showing the components assembled; an

DETAILED DESCRIPTION OF THE PREFERRED EMBODIMENT

Figure 1:
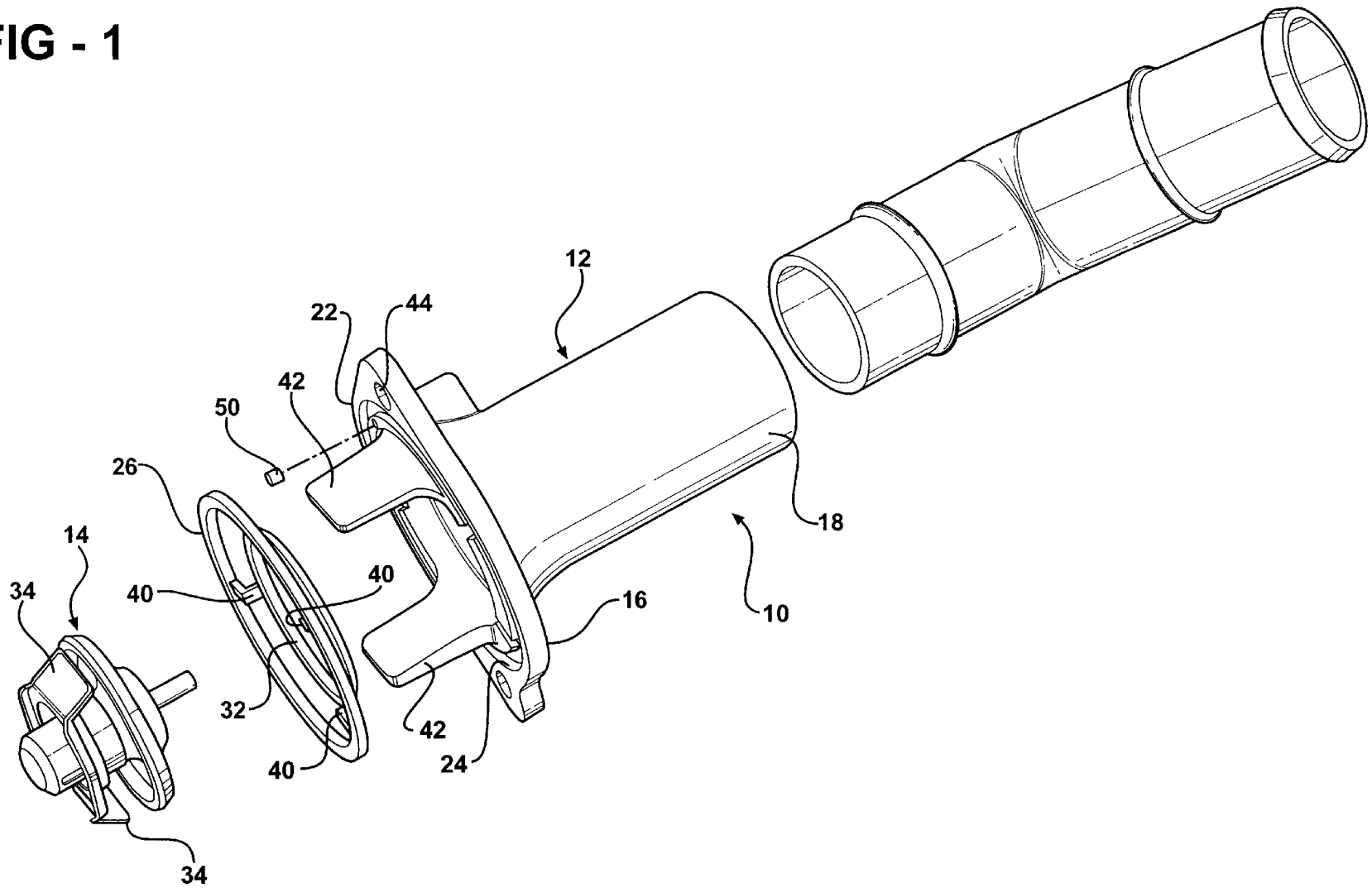
FIG. 1 is an exploded perspective view of the subject invention.
Figure 2:
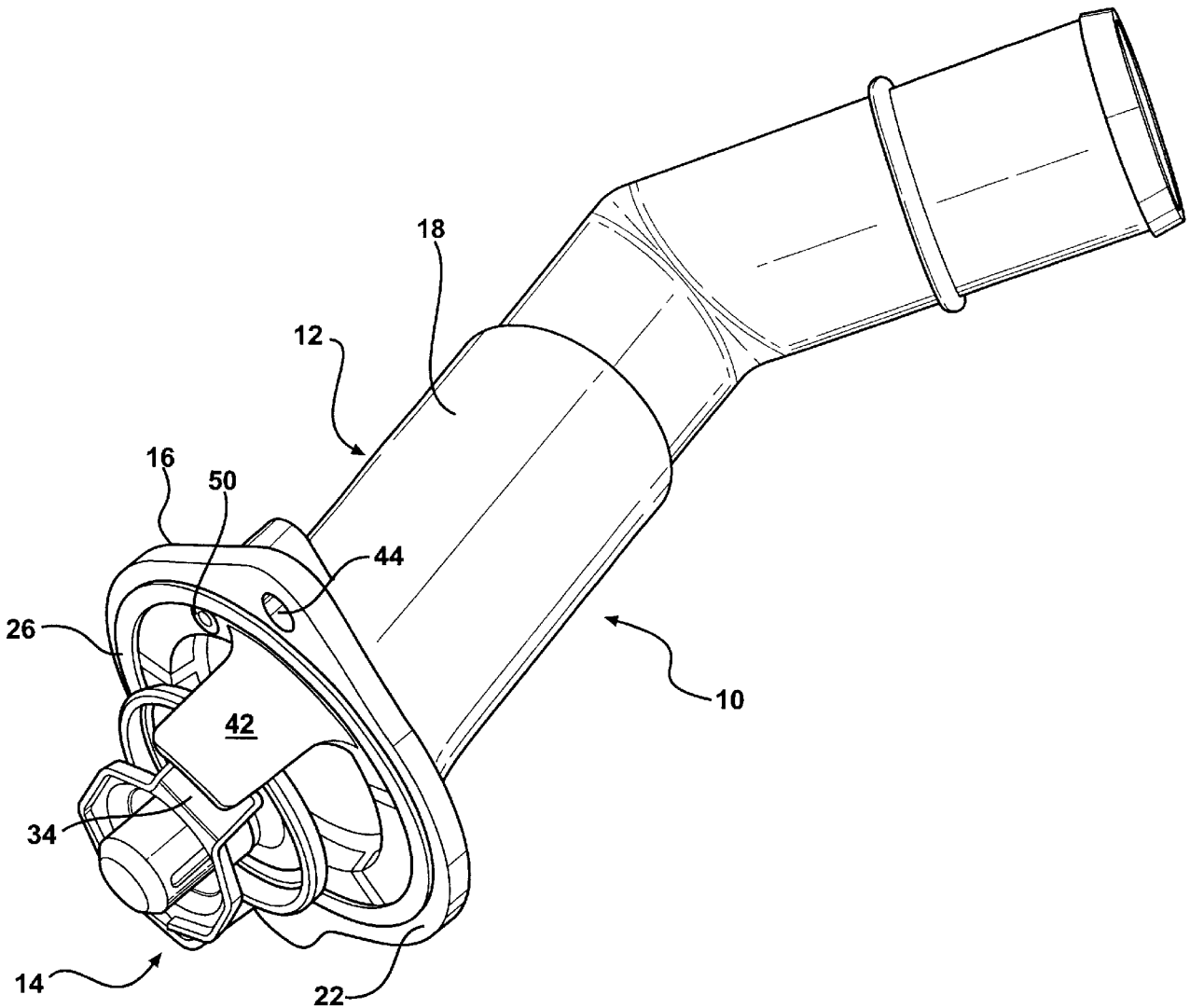
Figure 3:
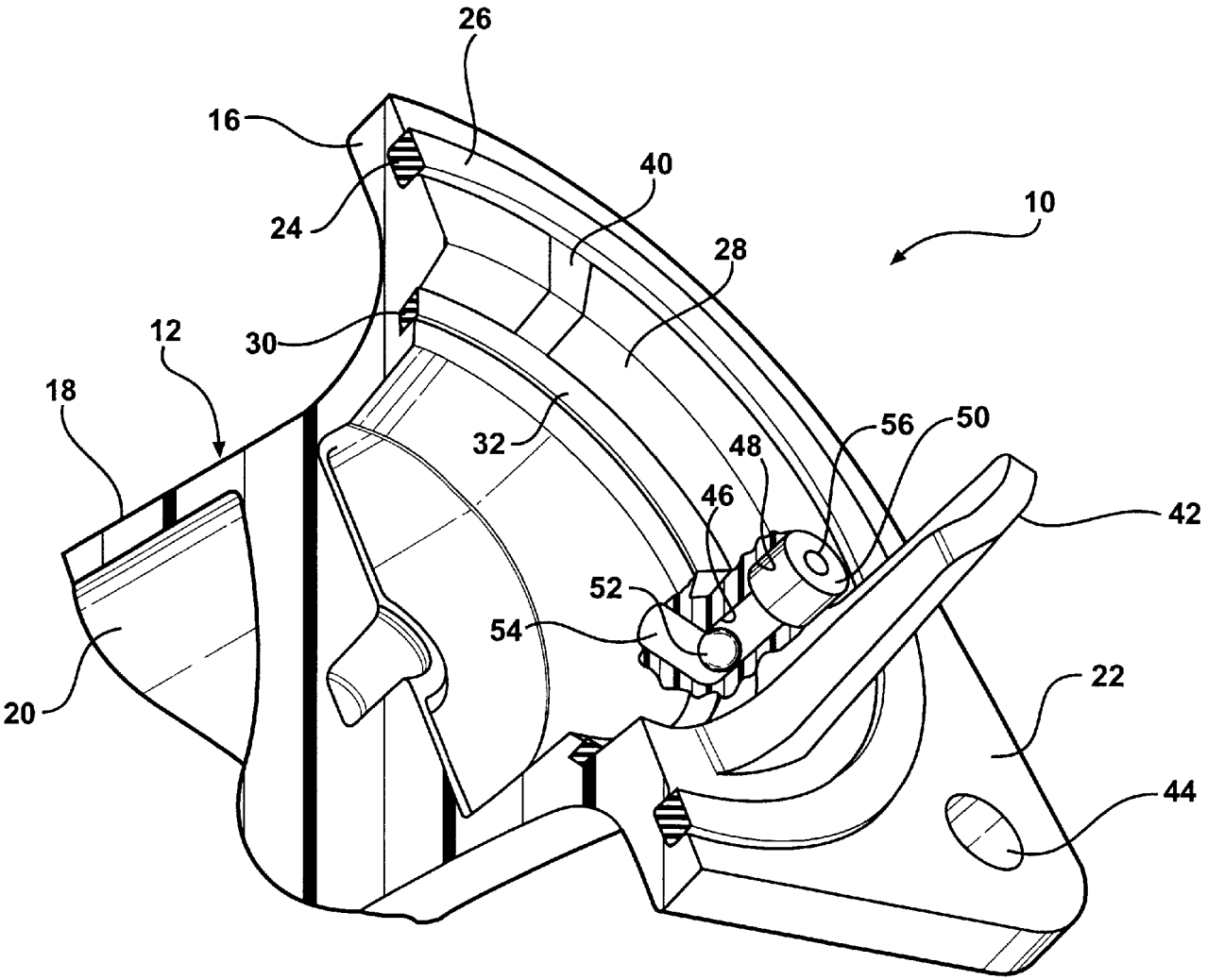
FIG. 3 is a perspective view partially cutaway and in cross section of the thermostat housing of the subject invention.

Referring to the Figures, wherein like numerals indicate like or corresponding parts throughout the several views, a thermostat housing assembly is generally shown at 10. The assembly 10 includes a housing, generally indicated at 12, and a thermostat or flow control valve, generally indicated at 14.

The housing 12 has a flange 16 for mounting the housing 12 on a support structure, such as an engine, and a tubular spout 18 extending from the flange 16 and defining a passageway 20 extending from an opening in the spout 18 to an opening in the flange 16 for fluid to flow therethough. The flange 16 presents a mounting face 22 for engaging the support structure and includes an outer seal groove 24 therein. An outer seal 26 is disposed in the outer seal groove 24 for sealing the flange 16 to the support structure, e.g., engine.

The flange 16 also has a recess 28 therein disposed radially inwardly of the outer seal groove 24 and having an annular wall extending downwardly to a bottom surrounding the passageway 20. The bottom has an inner seal groove 30 disposed therein and an inner seal 32 is disposed in the inner seal groove.

The flow control valve 14 is operable in response to temperature of a fluid to open and close to permit or prohibit flow of the fluid through the passageway 20 in the housing 12 and the valve 14 has a radially extending arms 34.

In order to retain the inner 32 and outer 26 seals during shipment and handling, a retention device is included for retaining at least one of the seals 26 and 32 in its respective groove 24 and 30. A plurality (three) spokes 40 interconnect the inner 32 and outer 26 seals and the retention device includes a mechanical interlock between each of the spokes 40 and the housing for retaining both of the seals in the respective grooves. The housing 12 includes a channel extending radially between the seal grooves 24 and 30 for receiving each of the spokes 40 and the mechanical interlock comprises an undercut in each of the channels and a shoulder on each of the spokes 40 for snapping over the undercut. Accordingly, as inner 32 and outer 26 seals are disposed in the respective inner 24 and outer 30 grooves, the spokes 40 are disposed in the channels and the shoulders snap over the undercuts thereby retaining the seals 26 and 32 in the grooves and attached to the housing 12.

The housing 12 includes a pair of support columns 42 extending upwardly from the mounting face 22 inside the outer seal 26 for supporting the thermostat 14 thereon. The columns include grooves for receiving and retaining the arms 34.

The flange 16 has at least two holes 44 extending therethrough for receiving fasteners, e.g., bolts, (not shown) for mounting the housing 12 on a support structure, such as the engine.

A vent passage extends between the passageway 20 and the mounting face 22 inside the outer seal 26. More specifically, the vent passage includes a valve portion 46 and a cap portion 48 with the cap portion 48 being larger in cross sectional area than the cap portion 48. A cap 50 is disposed in the cap portion 48 and a check valve 52 is disposed in the valve portion 46. The vent passage also includes an outlet portion 54 extending from the valve portion 46 to the passageway 20 in the housing 12, with the outlet portion 54 being smaller in cross sectional area than the valve portion 46. In other words, the various portions 46, 48 and 54 are circular bores with successively smaller diameters. Therefore, the check valve 52 is inserted into the vent passage and rests upon the bottom of the valve portion 46, i.e., the diameter of the outlet portion 54 that is smaller than the diameter of the ball check valve 52.

The cap 50 has a vent hole 56 therethrough and is disposed in the valve portion 48 of the vent passage for retaining the check valve 52 in the vent passage.

The assembly is characterized by the plastic material of the housing 12 being deformed into engagement with the cap 50 for retaining the cap 50 in the valve portion 48 of the vent passage. The cap 50 comprises a plastic material and is fused to the housing 12.

The method is characterized by deforming the plastic material of the housing 12 into engagement with the cap 50 for retaining the cap 50 in the vent passage. As alluded to above, the vent passage is formed with the cap portion 48 being larger in cross sectional area than the valve portion 46 whereby the check valve 52 is inserted in the and thereafter the cap 50 is inserted in the cap portion 48. The cap 50 bottoms out as it engages the smaller diameter of the valve portion 46, ie., the insertion of the cap 50 is limited by engagement with the valve portion 46.

The plastic material of the housing 12 may be softened by heat to engage the cap 50 and/or the cap 50 may be of a plastic material whereby the cap 50 retention is accomplished by fusing the plastic material of the housing 12 to the plastic material of the cap 50, e.g., by sonic welding.

The thermoplastic housing 12 and seal assembly can be molded using a two shot and/or insert molding and allows a removable thermostat. The housing 12 can consist of structural thermoplastic such as PPA, Nylon, PPS, or PBT. The seals may be of thermoplastic elastomers such as Polypropylene & EPDM based TPE, or fluoropolymers such as THV, FEP, PFA, EFTE, VFEP, etc., or one which is polyester based. One could also use a thermostat elastomer such as silicone.

Obviously, many modifications and variations of the present invention are possible in light of the above teachings. The invention may be practiced otherwise than as specifically described within the scope of the appended claims, wherein that which is prior art is antecedent to the novelty set forth in the "characterized by" clause. The novelty is meant to be particularly and distinctly recited in the "characterized by" clause whereas the antecedent recitations merely set forth the old and well-known combination in which the invention resides. These antecedent recitations should be interpreted to cover any combination in which the incentive novelty exercises its utility. In addition, the reference numerals in the claims are merely for convenience and are not to be read in any way as limiting.

What is claimed is:

1. A thermostat housing (12) assembly comprising;

a housing (12) of plastic material having a flange (16) for mounting said housing (12) on a support structure and a tubular spout (18) extending from said flange (16) and defining a passageway (20) extending from an opening in said spout (18) to an opening in said flange (16) for fluid to flow therethough, said flange (16) presenting a mounting face (22) for engaging the support structure and an outer seal groove (24) therein, an outer seal (26) disposed in said outer seal groove (24) for sealing said flange (16) to the support structure, a vent passage extending between said passageway and said mounting face inside said outer seal, and a check valve (52) disposed in said vent passage, a cap (50) having a vent hole (56) therethrough and disposed in said vent passage for retaining said check valve (52) in said vent passage, said assembly characterized by said plastic material of said housing (12) being deformed into engagement with said cap (50) for retaining said cap (50) in said vent passage.

2. An assembly as set forth in claim 1 wherein said cap (50) comprises a plastic material and is fused to said housing (12).

3. An assembly as set forth in claim 2 wherein said vent passage includes a valve portion (46) and a cap portion (48) with said cap portion (48) being larger in cross sectional area than said cap portion (48) and said cap (50) being disposed in said cap portion (48) and said check valve (52) being disposed in said valve portion (46).

4. An assembly as set forth in claim 3 wherein said vent passage includes an outlet portion (54) extending from said valve portion (46) to said passageway in said housing (12), said outlet portion (54) being smaller in cross sectional area than said valve portion (46).

5. An assembly as set forth in claim 4 wherein said housing (12) includes a pair of support columns extending upwardly from said mounting face inside said outer sea, for supporting a thermostat thereon.

6. An assembly as set forth in claim 5 wherein said flange (16) includes a recess (28) therein disposed radially inwardly of said outer seal groove (24) and having an annular wall extending downwardly to a bottom surrounding said passageway (20), said bottom having an inner seal groove (30) disposed therein and an inner seal (32) disposed in said inner seal groove (30).

7. A method of fabricating a thermostat housing (12) of plastic material having a flange (16) for mounting the housing (12) on a support structure and a tubular spout (18) extending from the flange (16) and defining a passageway (20) extending from an opening in the spout (18) to an opening in the flange (16) for fluid to flow therethough with the flange (16) presenting a mounting face (22) for engaging the support structure and an outer seal groove (24) therein and an outer seal (26) disposed in the outer seal groove (24) for sealing the flange (16) to the support structure and a vent passage extending between the passageway and the mounting face inside the outer seal, said method comprising the steps of;

inserting a check valve (52) into the vent passage, and inserting a cap (50) having a vent hole (56) therethrough into the vent passage for retaining the check valve (52) in the vent passage, said method characterized by deforming the plastic material of the housing (12) into engagement with the cap (50) for retaining the cap (50) in the vent passage.

8. A method as set forth in claim 7 further defined as inserting a cap (50) of a plastic material and fusing the plastic material of the housing (12) to the plastic material of the cap (50).

9. A method as set forth in claim 8 including forming the vent passage with a valve portion (46) and a cap portion (48) with the cap portion (48) being larger in cross sectional area than the valve cap portion (46) and inserting the check valve (52) in the valve portion (46) and thereafter inserting the cap (50) in the cap portion (48).

10. A method as set forth in claim 9 including forming the vent passage with an outlet portion (54) extending from the valve portion (46) to the passageway (20) in the housing (12) with the outlet portion (54) being smaller in cross sectional area than the valve portion (46).

11. A method as set forth in claim 10 including forming the housing (12) with a pair of support columns (42) extending upwardly from the mounting face (22) inside the outer seal (26) for supporting a thermostat (14) thereon.

* * * * *